US011289828B2

(12) United States Patent
Koellmann

(10) Patent No.: US 11,289,828 B2
(45) Date of Patent: Mar. 29, 2022

(54) CONDUCTOR TERMINAL

(71) Applicant: WAGO VERWALTUNGSGESELLSCHAFT MBH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 3 days.

(21) Appl. No.: 17/035,221

(22) Filed: Sep. 28, 2020

(65) Prior Publication Data

US 2021/0013638 A1 Jan. 14, 2021

Related U.S. Application Data

(63) Continuation of application No. PCT/EP2019/057865, filed on Mar. 28, 2019.

(30) Foreign Application Priority Data

| | | |
|---|---|---|
| Mar. 28, 2018 | (DE) | 20 2018 101 726.8 |
| Mar. 28, 2018 | (DE) | 20 2018 101 727.6 |
| Mar. 28, 2018 | (DE) | 20 2018 101 728.4 |
| Mar. 28, 2018 | (DE) | 20 2018 101 729.2 |
| Mar. 28, 2018 | (DE) | 20 2018 101 731.4 |
| Mar. 28, 2018 | (DE) | 20 2018 101 732.2 |
| Mar. 28, 2018 | (DE) | 20 2018 101 733.0 |
| Mar. 28, 2018 | (DE) | 20 2018 101 734.9 |
| Apr. 30, 2018 | (DE) | 10 2018 110 312.3 |

(51) Int. Cl.
*H01R 4/48* (2006.01)

(52) U.S. Cl.
CPC ..... *H01R 4/4836* (2013.01); *H01R 4/4845* (2013.01)

(58) Field of Classification Search
None
See application file for complete search history.

(56) References Cited

U.S. PATENT DOCUMENTS

| | | | |
|---|---|---|---|
| 9,466,895 | B2 | 10/2016 | Köllmann et al. |
| 10,193,245 | B2 | 1/2019 | Lorenschat et al. |

(Continued)

FOREIGN PATENT DOCUMENTS

| | | | |
|---|---|---|---|
| DE | 10 2011 110 640 | A1 | 2/2013 |
| DE | 10 2013 101 409 | A1 | 8/2014 |

(Continued)

*Primary Examiner* — Ross N Gushi
(74) *Attorney, Agent, or Firm* — Muncy, Geissler, Olds & Lowe, P.C.

(57) ABSTRACT

A conductor connection terminal with an insulating material housing, which has a conductor insertion channel, a busbar in the insulating material housing and a clamping spring. The clamping spring has a contact leg which is supported on the busbar, a spring arch adjoining the contact leg, a clamping leg with a clamping edge adjoining the spring arch, which together with the busbar form a clamping point for clamping an electrical conductor, and a pull tab projecting from the clamping leg. Furthermore, the conductor connection terminal has an operating lever which is pivotably mounted in the insulating material housing, wherein the operating lever has a driver lug and is designed to grip the pull tab with the driver lug and to move the pull tab when the operating lever is pivoted so as to open and close the clamping point.

11 Claims, 4 Drawing Sheets

(56) References Cited

U.S. PATENT DOCUMENTS

| | | | |
|---|---|---|---|
| 10,665,965 | B2 | 5/2020 | Lorenschat et al. |
| 2020/0153125 | A9 | 5/2020 | Lorenschat et al. |

FOREIGN PATENT DOCUMENTS

| | | | |
|---|---|---|---|
| DE | 10 2014 114 026 | A1 | 3/2016 |
| DE | 20 2016 100 798 | U1 | 6/2017 |
| EP | 0 837 526 | A1 | 4/1998 |

CONDUCTOR TERMINAL

This nonprovisional application is a continuation of International Application No. PCT/EP2019/057865, which was filed on Mar. 28, 2019, and which claims priorities to German Patent Application No. 10 2018 110 312.3, which was filed in Germany on Apr. 30, 2018, German Patent Application No. 20 2018 101 726.8, which was filed in Germany on Mar. 28, 2018, German Patent Application No. 20 2018 101 727.6, which was filed in Germany on Mar. 28, 2018, German Patent Application No. 20 2018 101 728.4, which was filed in Germany on Mar. 28, 2018, German Patent Application No. 20 2018 101 729.2, which was filed in Germany on Mar. 28, 2018, German Patent Application No. 20 2018 101 731.4, which was filed in Germany on Mar. 28, 2018, German Patent Application No. 20 2018 101 732.2, which was filed in Germany on Mar. 28, 2018, German Patent Application No. 20 2018 101 733.0, which was filed in Germany on Mar. 28, 2018, German Patent Application No. 20 2018 101 734.9, which was filed in Germany on Mar. 28, 2018, and which are both herein incorporated by reference.

BACKGROUND OF THE INVENTION

Field of the Invention

The present invention relates to a conductor connection terminal with an insulating material housing, which has a conductor insertion channel, a busbar in the insulating material housing and a clamping spring which has a contact leg supported on the busbar, a spring arch adjoining the contact leg, a clamping leg with a clamping edge adjoining the spring arch, which together with the busbar form a clamping point for clamping an electrical conductor, and has a pull tab projecting from the clamping leg, and with an operating lever which is pivotably mounted in the insulating material housing, wherein the operating lever has a driver lug and is designed to grip the pull tab with the driver lug and move the pull tab when the operating lever is pivoted so as to open and close the clamping point.

Description of the Background Art

Conductor connection terminals are used, for example, in the form of terminal blocks, circuit board terminals, socket terminals or the like so as to clamp electrical conductors and connect these in an electrically conductive manner to the busbar and to a circuit component electrically connected to the busbar.

In particular, to remove the electrical conductor clamped to the busbar with the clamping edge, the clamping point must be opened by moving the clamping leg. For this purpose, lever-actuated conductor connection terminals having an operating element pivotably mounted in the insulating material housing are known.

DE 10 2011 110 640 A1 discloses such a conductor terminal with an insulating housing, with a spring clamp connection having a clamping spring and a busbar, and with an operating lever which is mounted in a lever bearing contour of the insulating housing with an electrically connected that it can pivot about a pivot axis. The clamping spring is connected to the operating lever by an operating leg projecting from the clamping leg in the direction of the operating lever. For this purpose, a curved end of the operating arm is suspended in an operating section which is located between the pivot axis and the lever arm section which projects out of the insulating housing.

DE 10 2014 114 026 A1, which corresponds to U.S. Pat. No. 10,665,965, which is incorporated herein by reference, shows a conductor terminal with an insulating housing, a contact insert arranged therein with a contact piece and a clamping spring, and with an operating lever pivotably mounted in the insulating housing for operating the clamping spring. The operating lever has a pull arm which engages behind a driver element of the clamping spring. The driver face of the pull arm extends essentially radially towards the bearing pin, wherein the support of the clamping spring on the pull arm remains almost unchanged during the pivoting movement of the operating lever.

SUMMARY OF THE INVENTION

It is therefore an object of the present invention to create an improved conductor connection terminal which, with a compact, short construction of the conductor connection terminal, ensures good and safe lever guidance with an improved dynamic effect.

It is proposed that the operating surface which comes into contact with the pull tab when it is gripped extends in a concentric section around a center of rotation of the operating lever. The distance between the operating surface of the driver lug and the center of rotation becomes greater over the length of the driver lug towards the free end of the driver lug. That is, the operating surface extends in a spiral section towards the center of rotation. By means of this arcuate operating surface oriented towards the rotation center, it is ensured when pivoting the operating lever that the portion of the pull tab resting on the operating surface slides along the driver lug and is thereby guided towards the center of rotation when the operating lever is pivoted from a closed position to an open position for opening the clamping point. The center of rotation is specified, for example, by a structurally available or virtual axis of rotation of the operating lever.

The pull tab can have an engagement opening for receiving the driver lug. This engagement opening can be delimited by a transverse web with a support tab projecting transversely from the plane of the pull tab and at least one side web. The driver lug of the operating lever is then designed and aligned in such a way that the operating surface of the driver lug engages under the support tab when the operating lever is pivoted into the open position. The support tab then rests on the operating surface and is displaced towards the axis of rotation together with the transverse web, so that the distance between the support tab to the axis of rotation and the park position to the open position of the operating lever is reduced by a pivoting of the operating lever.

The support surface can have a curved, in particular convex support plane the driver lug. This has the advantage that the friction between the driver lug and the support tab is reduced and the threading of the driver lug, when dipping into the engagement opening, is reduced while reducing the risk of tilting.

The support of the driver lug on the pull tab can be in the area of the alignment between the center of rotation of the operating lever and the clamping edge of the clamping leg. The support does not have to be exactly on the alignment line. It can be arranged next to the alignment line within a tolerance range of a few millimeters. By aligning the support on the alignment line, self-locking during opening and closing is prevented. These kinematics also largely reduce the deflection of the pull tab perpendicular to the extension direction of the pull tab of the clamping spring. The decrease in the distance between the center of rotation and the operating surface of the driver lug during the pivoting movement of the operating lever from the closed position into the open position reduces the acting lever arm between the center of rotation and the driver face, so that the spring forces growing with increasing deflection of the clamping spring can be compensated. In this case, for the operator, the required operating forces remain essentially at least constant or increase only insignificantly during the pivoting movement. With an appropriate design of the geometric relationships, the operating forces can also decrease during the pivoting movement of the operating lever from the closed position to the open position.

The insulating material housing can have a latching contour with a latching recess and the operating lever can have a stop edge. In an open position of the operating lever, in which the clamping point is open, the stop edge immerses in the latching recess and forms a stop which holds the operating lever in the open position. Thus, in the open position, the operating lever is pulled into a latching position by the spring force of the clamping spring, which automatically holds the clamping edge in the open position. To close the clamping point, this stop must then be overcome by shifting the operating lever.

The insulating material housing can have a part-circular pivot bearing contour. The center of rotation of the operating lever is then rotatably supported in the curved pivot bearing contour of the insulating material housing when the operating lever is pivoted from a park position to the open position. In the open position, the operating lever is then mounted displaceably in the part-circular pivot bearing contour by the tensile force of the clamping spring. Thus, when pivoting from the closed position to the open position, the operating lever is rotatably mounted about an imaginary virtual or structurally available axis of rotation. In the open position, however, linear displacement radially towards the axis of rotation is possible. By means of the tensile force of the clamping spring, which acts on the operating lever, the center of rotation of the operating lever can be guided out from the part-circular pivot bearing contour radially towards the rotational axis so as to thereby allow for the stop contour to be moved into the latching recess. The operating lever is then held in this locked open position by the tensile force of the clamping spring, which is exerted on the operating lever via the pull tab.

To this end, the operating lever can have at least one pivot pin which dips into an elongated hole in the insulating material housing that forms the pivot bearing contour. However, it is also conceivable that the operating lever has at least one elongated hole into which a pivot pin of the insulating material housing, which forms the pivot bearing contour, is inserted.

The operating lever can, however, also be mounted in a floating manner with its center of rotation in the insulating material housing without a structurally predetermined, projecting axis of rotation being present. The part-circular support contours can be formed by curved end faces of the operating lever, which are mounted in correspondingly designed curved guide surfaces of the insulating material housing.

The operating lever can have a guide wall which is spaced apart from the driver lug by a gap. A web of the insulating material housing is then arranged in this gap between the driver lug and the guide wall. By means of such a guide wall, which can be designed for example as a segment-like circular guide disc, at least in sections, on the operating lever side, mounting stability is in particular improved with regard to tilting of the operating lever. In addition, this succeeds in increasing the clearance and creepage distances between current-carrying parts of the conductor connection terminal and the outer surface of the insulating material housing in a structurally simple and space-saving manner.

For the purposes of the present invention, the indefinite article "a" is to be understood as such and not as a numerical word. A conductor connection terminal can therefore also have a plurality of busbars and a plurality of clamping springs for connecting a plurality of electrical conductors with more than one operating lever. Combinations of different conductor connection technologies are also conceivable, for example the combination of a spring-loaded terminal connection with a clamping spring in one part of the busbar and an IDC connection (insulation displacement connection) to another part of the busbar.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
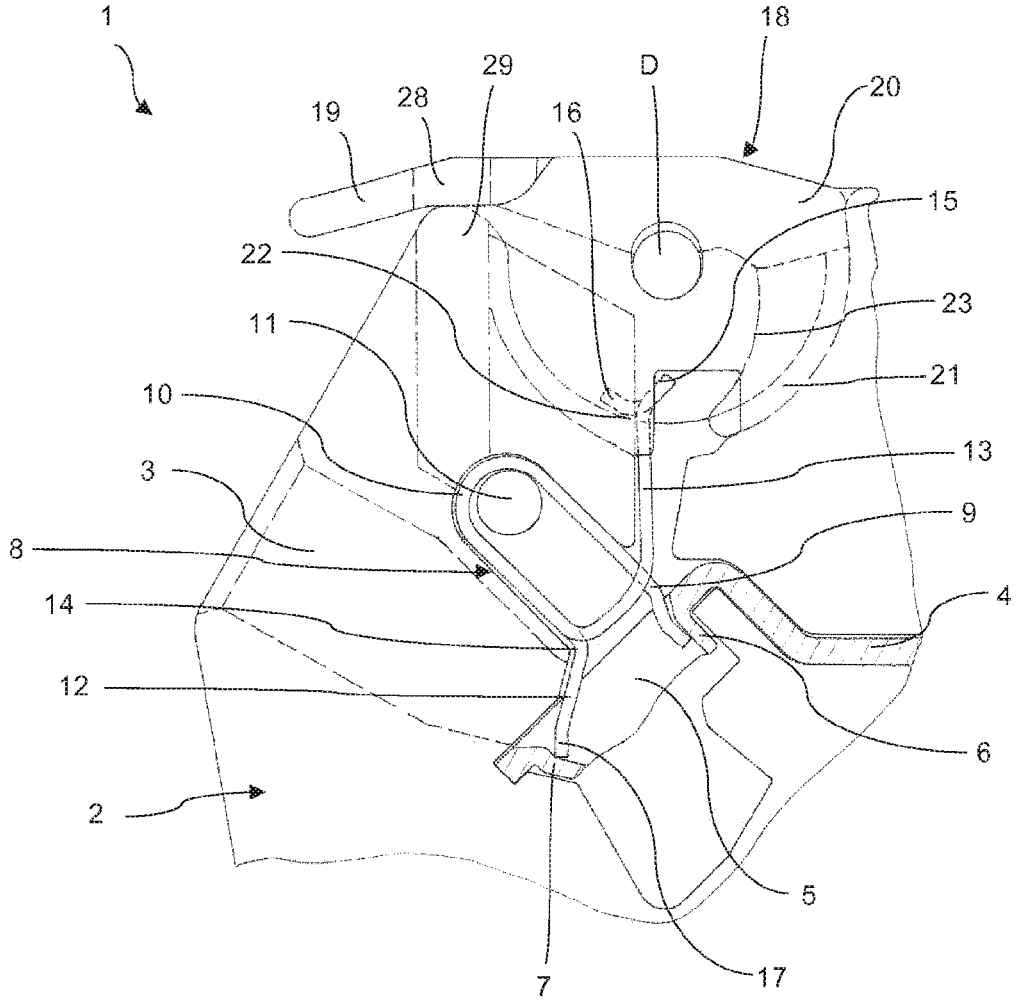
FIG. 1 shows a side sectional view of a conductor connection terminal with a partial section in the park position.

FIG. 1 shows a side sectional view of a conductor connection terminal 1 in a partial section. The conductor connection terminal 1 has an insulating material housing 2 into which a conductor insertion channel 3 is introduced. A busbar 4 is built into the insulating material housing 2. In the exemplary embodiment shown, the busbar 4 has a material passage with a conductor insertion opening 5 which is delimited by a flange 6. The flange 6 projects transversely towards the plane of the busbar 4, which spans said plane in the area of the conductor insertion opening 5. The flange 6 further has a contact surface 7 which does not transversely project from the plane like the adjacent flange walls but rather is placed at an angle hereto.

A clamping spring 8 is suspended in the conductor insertion opening 5. This clamping spring 8 has a contact leg 9, the free end of which dips into the conductor insertion opening 5 and rests on the busbar 4. This free end can have an S-shaped bend so as to align the position of the clamping spring 8. A spring arch 10 connects to the contact leg 9. This spring arch 10 can then be guided around a bearing pin 11 of the insulating material housing 2, with which undesired tilting of the clamping spring 8 is prevented. A clamping leg 12, the free end of which projects into the conductor insertion opening 5, adjoins the spring arch 10. In the exemplary embodiment shown, the free end of the clamping leg 12 has a bend 14, so that the free end of the clamping leg 12 does not run approximately parallel to the contact leg 9, but rather points obliquely away from the direction in which the contact leg 9 extends. A pull tab 13 is formed integrally with the clamping leg 12. This is cut free from the clamping leg 12 and bent in the area of the bend 14 from the clamping leg 12 in the direction of the contact leg 9. This means that the free end of the clamping leg 12 has a smaller width than the section of the clamping leg 12 adjoining the spring arch 10, since part of the material of the clamping leg 12 is used to form the pull tab 13. This pull tab 13 can be formed from the material on one side edge of the clamping leg 12. However, it is also advantageous if the pull tab 13 is laid open on the two opposite sides of the clamping leg 12 by the latter and is formed by two webs which are brought together at their free end by a transverse web 15. As shown, a support tab 16 may be provided to the transverse web 15, which, as shown, transversely projects from the plane of the pull tab 13 and has a curved support plane 22. The transverse web 15 is also bent out of the plane of the pull tab 13 so as to form a U-shaped cross section together with the support tab 16.

It can be seen that the free end of the clamping leg 12 has a clamping edge 17 which, in the illustrated non-actuated position, rests on the contact surface 7 without an inserted electrical conductor. In this position, the clamping point formed by the clamping edge 17 and the contact surface 7 for clamping an electrical conductor is closed. A rigid or sufficiently strong multi-wire electrical conductor can be inserted through the conductor insertion channel 3. This then strikes the free end of the clamping leg 12 and displaces the latter towards the contact leg 9, so that the electrical conductor is guided along between the clamping edge 17 and the contact surface 7 of the flange 6. Such an electrical conductor can thus be plugged in and clamped by operating the clamping spring 8 without opening the clamping point beforehand.

In the case of a flexible electrical conductor, however, the strands would deform in the attempt of inserting said conductor directly. Therefore, the clamping point must be opened before connecting such an electrical conductor. An electrical conductor is clamped by the clamping force of the clamping spring 8 by means of the clamping edge 17, which is locked on the electrical conductor. An electrical conductor can therefore not simply be pulled out of the clamping point. To disconnect an electrical conductor, in particular a flexible electrical conductor, it is necessary to open the clamping spring 8.

For this purpose, the conductor connection terminal 1 has an operating lever 18 pivotably mounted in the insulating material housing 2. The operating lever 18 has an operating arm 19 which projects from the insulating material housing 2 and merges into a main body 20. The main body 20 carries a driver lug 21 on the side opposite the operating arm 19. In the closed position shown, the driver lug 21 is not in engagement with the pull tab 13. Rather, its free end is spaced from the pull tab 13 and the transverse web 15 of the pull tab 13.

It is also clear that the operating lever 18 has a center of rotation D, which in the illustrated embodiment is formed as a pivot with a defined axis of rotation. A floating mounting of the operating lever 18 with a moving center of rotation D is also conceivable.

It can also be seen that the curved support plane of the support tab 16 on the transverse web 15 lies in the area of alignment between the center of rotation D, in particular the center point of an axis of rotation, and the clamping edge 17.

If the operating lever 18 is now pivoted clockwise about the rotational center D by gripping the operating arm 19, then the free end of the driver lug 21 is moved towards the pull tab 13. The driver lug 21 then slides past the at least one lateral web of the pull tab 13 and engages under the support tab 16. This support tab 16 then slides down on the curved operating surface 23, which extends over the length of the driver lug 21 in a concentric portion about the center of rotation D of the operating lever 18. It becomes clear that this curved operating surface 23 has a spiral course, in which the distance between the operating surface 23 of the driver lug 21 and the center of rotation D, in particular the center of the rotation center D, increases over the length of the driver lug 21 from the driver lug 21 junction towards the main body 20 to the free end of the driver lug 21. If the support tab 16 of the pull tab 13 resting on the operating surface 23 slides on this operating surface 23 when the operating lever 18 is pivoted clockwise, then the distance between the support tab 16 and the center of rotation D is reduced by the concentric spiral-shaped section of the operating surface 23 with respect to the center of rotation D.

Figure 2:
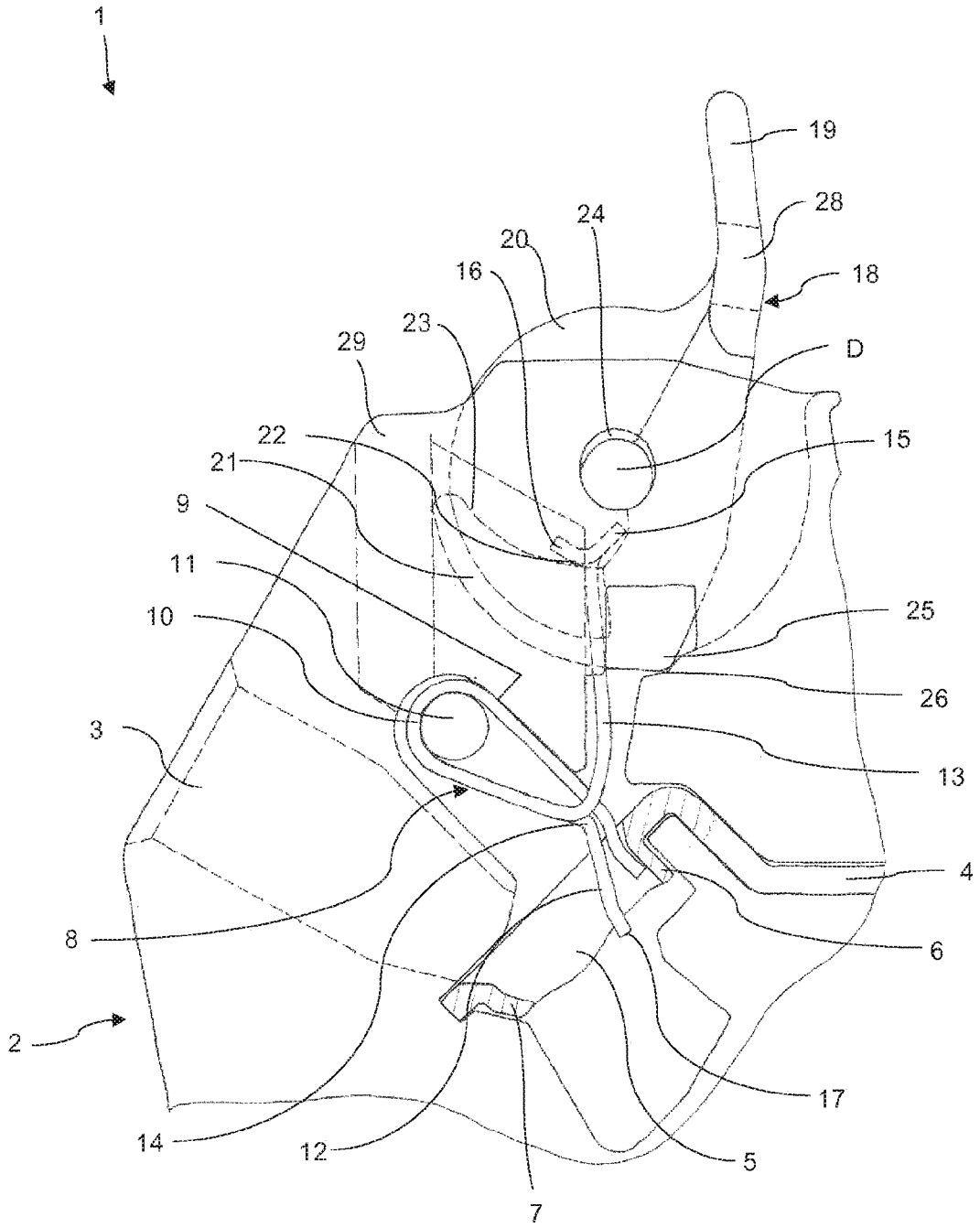
FIG. 2 shows a side sectional view of the conductor connection terminal from FIG. 1 in the open position.

This can be seen from FIG. 2, which shows the conductor connection terminal 1 from FIG. 1 in the open position. Here, too, the curved support plane 22 of the support tab 16 is in the area of alignment between the center of rotation D and the clamping edge 17. It is clear that the clamping edge 17 has now moved away from the contact surface 7 and that the clamping point in the opening of the conductor insertion channel 3 is now opened. The clamping leg 12 is displaced towards the contact leg 9. The spring force of the clamping spring 8, which is pretensioned in this state, now exerts a tensile force on the pull tab 13, which acts on the driver arm 23 via the support plane 22 of the support tab 16. The operating lever 18 is pulled down to the busbar 4. It can be seen that the pivot which forms the center of rotation D is mounted in an elongated hole 24 of the insulating material housing 2. This way, the operating lever 18 can be pulled upwards again. In the illustrated open position, the operating lever 18 is latched onto the insulating material 2 in that a stop edge 25 of the operating lever 18 immerses in a latching recess 26 of the insulating material housing 2. The operating lever 18 is thus locked in the open position even if the clamping spring 8 exerts a tensile force on the operating lever 18, by which the operating lever 18 would be sprung back into the park position from FIG. 1. By pulling the operating lever 18 upwards in the elongated hole 24, the stop edge 15 can be lifted from the latching recess 26 to then again pivot the operation lever 18 counter-clockwise into the park position. Alternatively, pivoting the operating lever counterclockwise when the torque is exceeded, up to which point the locking of the stop edge 25 of the operating lever 18 on the latching recess 26 is maintained, leads to an over-pressing of the engagement and thus to an upward movement of the operating lever 18, in which the locking pin of the center of rotation D in the elongated hole 24 moves upwards.

Figure 3:
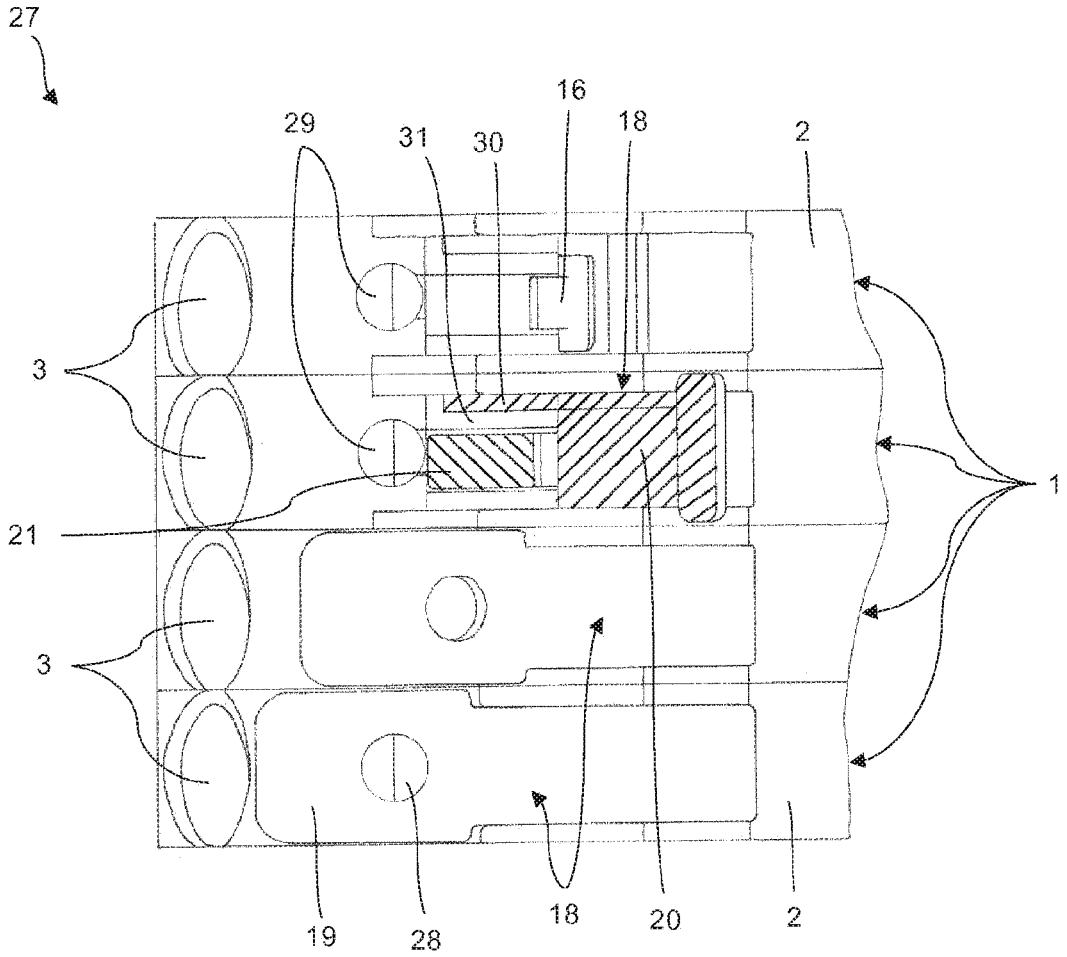
FIG. 3 shows a plan view of a conductor terminal block with a plurality of conductor connection terminals lined up next to one another without operating levers and with operating levers in different positions.

FIG. 3 shows a plan view of a conductor terminal block 27 with a plurality of conductor connection terminals 1 of the kind previously described, connected side by side with the side faces adjoining one another. In this case, the operating levers 18 are in different positions. The operating lever 18 of the lower conductor connection terminal 1 is in a closed position as per FIG. 1. It can be seen that the operating lever 18 has a test opening 28 on the lever arm 19 which opens into a test channel 29 leading to the spring arch 10. Thus, a testing tool can be inserted through the test opening 28 into the test channel 29 so as to measure electric potential applied to the clamping spring 8.

This orientation of the test opening 28 with the test channel 29 in alignment in the closed position can also be seen from the sectional illustration in FIG. 1.

When the operating lever 18 is then pivoted upwards and away from the insulating material housing 2, the driver lug 21 engages under the support tab 16 of the pull tab 13 when a working position is reached. This working position is reached in the position as it is shown below in the second conductor connection terminal 1.

In the case of the second conductor connection terminal 1 from above, the operating lever 18 is now shifted from the working position to the open position around the working stroke. It is now clear that the rest of the driver lug 21 projecting beyond the transverse web 15 extends freely towards the test channel 29 and the conductor insertion channel 3.

It can be seen that the operating lever 18 has a guide wall 30 which is spaced apart from the driver lug 21 by a gap. It becomes clear that a web 31 of the insulating material housing 2 is arranged in this gap between the guide wall 30 and the driver lug 21. Thus, the tilt resistance of the position of the operating lever 18 in the insulating material housing 2 is enhanced and the clearance and creepage distances are increased.

The top conductor connection terminal 1 of the terminal block 27 is shown without a built-in operating lever 18. It can be seen that the web 31 projects into the free space of the insulating material housing 2 provided for the driver lug 21 and the guide wall 30.

Figure 4:
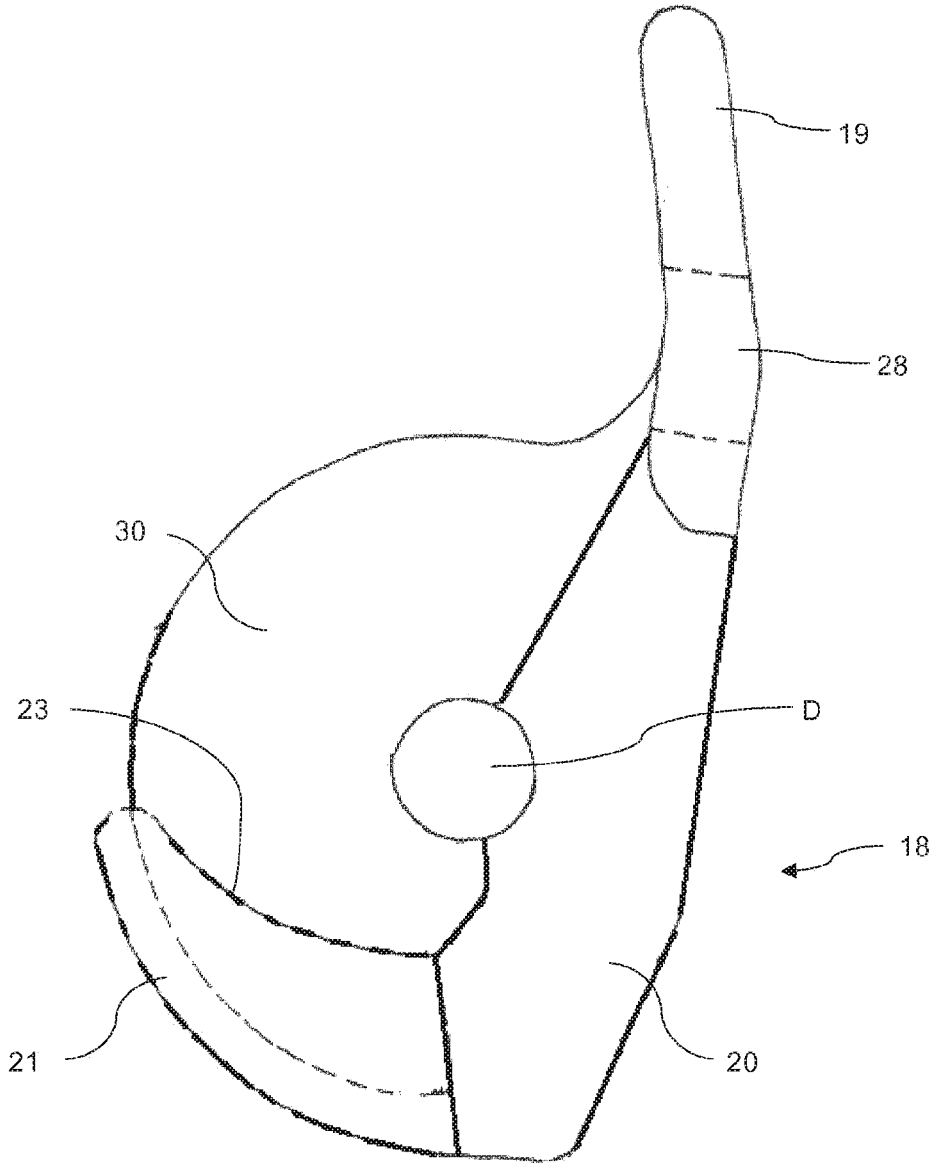
FIG. 4 shows a side view of the operating lever.

FIG. 4 shows a side view of the operating lever 18. It can be seen that the driver lug 21 extends from the main body 20 with a curved course conically tapering towards the free end. It becomes clear that the driver lug 21 is aligned with its operating surface 23 transversely to the radius of the center of rotation D and thus concentrically to the center of rotation D. The operating surface 23 represents a distance to the center of rotation D, which decreases in a spiral manner towards the center of rotation D with a free end for transitioning into the main body 20.

It becomes clear that, by partially overlapping the driver lug 21, a part-circular disc-shaped guide wall 30 projects from the main body 20 at a distance from the driver lug 21. There is a gap between the driver lug 21 and the guide wall 30, as can be seen in FIG. 3.

It can also be seen that the free end of the driver lug 21 is rounded so as to facilitate threading into the pull tab 13.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

an insulating material housing;

a conductor insertion channel;

a busbar formed in the insulating material housing;

a clamping spring, which has a contact leg supported on the busbar;

a spring arch adjoining the contact leg;

a clamping leg with a clamping edge adjoining the spring arch, which together with the busbar forms a clamping point for clamping an electrical conductor;

a pull tab projecting from the clamping leg; and an operating lever which is pivotably mounted in the insulating material housing, wherein the operating lever has a driver lug and is designed to grip the pull tab with the driver lug and to move the pull tab when the operating lever is pivoted so as to open and close the clamping point, wherein an operating surface of the driver lug, which comes into contact with the pull tab when gripped, extends in a concentric section about a center of rotation of the operating lever, and wherein a distance between the operating surface of the driver lug and the center of rotation of the operating lever increases over a length of the driver lug towards a free end of the driver lug.

2. The conductor connection terminal according to claim 1, wherein the pull tab has an engagement opening for receiving the driver lug, wherein the engagement opening is delimited by a transverse web and at least one side web, wherein the transverse web has a support tab that projects transversely with respect to a plane of the pull tab.

3. The conductor connection terminal according to claim 2, wherein the support tab has a curved support plane for the driver lug.

4. The conductor connection terminal according to claim 1, wherein the contact of the operating surface of the driver lug and the pull tab occurs in an area of an alignment between the center of rotation of the operating lever and the clamping edge of the clamping leg.

5. The conductor connection terminal according to claim 1, wherein the insulating material housing has a latching contour with a latching recess and the operating lever has a stop edge, wherein the stop edge dips into the latching recess in an open position of the operating lever and forms a stop which holds the operating lever in the open position.

6. The conductor connection terminal according to claim 5, wherein the insulating material housing has an at least part-circular pivot bearing contour, and the center of rotation of the operating lever is rotatably mounted in the curved pivot bearing contour of the insulating material housing when the operating lever is pivoted between a closed position and an open position and is mounted displaceably in the open position by the tensile force of the clamping spring in the part-circular pivot bearing contour.

7. The conductor connection terminal according to claim 6, wherein the operating lever has at least one pivot which dips into an elongated hole of the insulating material housing, which forms the pivot bearing contour.

8. The conductor connection terminal according to claim 6, wherein the operating lever has at least one elongated hole into which a pivot of the insulating material housing, which forms the pivot bearing contour, is immersed.

9. The conductor connection terminal according to claim 6, wherein the operating lever with its center of rotation is mounted in a floating manner in the insulating material housing.

10. The conductor connection terminal according to claim 1, wherein the operating lever has a guide wall which is spaced apart from the driver lug by a gap, wherein in the assembled state, a web of the insulating material housing is arranged in the gap.

11. A conductor connection terminal comprising:

an insulating material housing;

a conductor insertion channel;

a busbar formed in the insulating material housing;

a clamping spring which has a contact leg supported on the busbar;

a spring arch adjoining the contact leg;

a clamping leg with a clamping edge adjoining the spring arch which, together with the busbar, forms a clamping point for clamping an electrical conductor, a pull tab projecting from the clamping leg; and an operating lever which is pivotably mounted in the insulating material housing, wherein the operating lever has a driver lug and is formed to grip the pull tab with the driver lug and designed to move the pull tab when the operating lever is pivoted so as to open and close the clamping point, wherein the operating lever has a guide wall which is spaced apart from the driver lug by a gap, and wherein in the assembled state, a web of the insulating material housing is arranged in the gap.

* * * * *